US007475500B2

(12) United States Patent
Covatch

(10) Patent No.: US 7,475,500 B2
(45) Date of Patent: Jan. 13, 2009

(54) SHOE WITH IMPROVED CONSTRUCTION

(75) Inventor: Charles E. Covatch, Martinsburg, PA (US)

(73) Assignee: Columbia Insurance Company, Omaha, NE (US)

( * ) Notice: Subject to any disclaimer, the term of this patent is extended or adjusted under 35 U.S.C. 154(b) by 134 days.

(21) Appl. No.: 11/174,415

(22) Filed: Jul. 1, 2005

(65) Prior Publication Data

US 2007/0000150 A1 Jan. 4, 2007

(51) Int. Cl.
*A43B 3/24* (2006.01)
*A43B 7/22* (2006.01)

(52) U.S. Cl. ..... 36/100; 36/101; 36/91

(58) Field of Classification Search ..... 36/91, 36/100, 101, 155–165
See application file for complete search history.

(56) References Cited

U.S. PATENT DOCUMENTS

| | | | | | |
|---|---|---|---|---|---|
| 1,300,998 | A | | 4/1919 | Nelson | |
| 1,515,086 | A | | 11/1924 | Baluta | |
| 2,082,891 | A | * | 6/1937 | Hubbard | 36/160 |
| 2,878,593 | A | * | 3/1959 | Lockridge | 36/169 |
| 3,041,743 | A | | 7/1962 | Monsma | |
| 3,777,419 | A | | 12/1973 | Nalick | 36/71 |
| 4,316,333 | A | * | 2/1982 | Rothschild | 36/50.1 |
| 4,575,954 | A | * | 3/1986 | Bye | 36/89 |
| 5,138,774 | A | * | 8/1992 | Sarkozi | 36/164 |
| 5,253,434 | A | | 10/1993 | Curley, Jr. et al. | 36/55 |
| 5,282,326 | A | | 2/1994 | Schroer, Jr. et al. | 36/44 |
| 5,345,701 | A | | 9/1994 | Smith | 36/144 |
| RE34,890 | E | | 4/1995 | Sacre | 36/55 |
| 5,499,459 | A | * | 3/1996 | Tomaro | 36/10 |
| 5,526,584 | A | | 6/1996 | Bleimhofer et al. | 36/10 |
| 5,659,914 | A | | 8/1997 | Steinlauf | 12/145 |
| 5,689,903 | A | | 11/1997 | Aumann | 36/77 |
| 5,964,047 | A | * | 10/1999 | Covatch | 36/55 |
| 5,970,629 | A | | 10/1999 | Tucker et al. | 36/51 |
| 6,003,212 | A | | 12/1999 | Imahata | 24/578 |
| 6,170,174 | B1 | * | 1/2001 | Gesso | 36/72 R |
| 6,381,876 | B2 | * | 5/2002 | Krajcir | 36/72 R |
| 6,618,962 | B1 | * | 9/2003 | Covatch | 36/72 R |
| 6,701,641 | B2 | | 3/2004 | Tung | 36/55 |
| 2001/0007180 | A1 | | 7/2001 | Bordin et al. | 36/93 |
| 2003/0093920 | A1 | | 5/2003 | Greene et al. | 36/25 |
| 2003/0097768 | A1 | | 5/2003 | Baek | 36/55 |
| 2004/0064974 | A1 | | 4/2004 | Schuster | 36/91 |
| 2004/0139628 | A1 | | 7/2004 | Wiener | 36/10 |
| 2004/0216332 | A1 | | 11/2004 | Wilson et al. | 36/55 |
| 2004/0226192 | A1 | | 11/2004 | Geer et al. | 36/102 |
| 2005/0011083 | A1 | * | 1/2005 | Kosted | 36/9 R |
| 2006/0070262 | A1 | * | 4/2006 | Shaw et al. | 36/77 R |

* cited by examiner

*Primary Examiner*—Ted Kavanaugh
(74) *Attorney, Agent, or Firm*—St. Onge Steward Johnston & Reens LLC

(57) ABSTRACT

The invention relates to a shoe for providing enhanced comfort and protection to a user's foot having a sole with a top surface, an upper placed above the top surface, an optional arch made of a single unit of malleable material and placed between the top surface and upper, and an optional metatarsal guard made of a single unit of malleable material and placed between the top surface and upper. A bootie having a bottom is removably attached to the top surface by a securing mechanism placed between the top surface and bottom of bootie. The invention also includes a method for making the shoe.

14 Claims, 8 Drawing Sheets

SHOE WITH IMPROVED CONSTRUCTION

FIELD OF THE INVENTION

The invention relates to a shoe with improved construction.

BACKGROUND OF THE INVENTION

Shoes that employ liners often attach the liners to the interior of the shoes to provide comfort and support. The construction and thickness of the liners often vary depending upon certain uses of the shoes. For cold temperatures, an insulating liner may be used. For warm temperatures, a wicking or air permeable material may be used to make the liner. For wet conditions, a waterproof material may be used for the liner.

The liner that is made of a waterproof material may be a sock-like insert, which is often termed a bootie, that is usually stitched at the upper end of the bootie, such as the ankle or shin area, to the shoe. In this fashion, the holes in the material, as a result of the stitching, do not typically create a passage through which water passes since the holes are located at the upper end of the bootie and water typically is at or below the holes.

However, securing a bootie at the top without any securement at the bottom of the bootie may permit the bootie to move or slide relative to the rest of the shoe.

U.S. Pat. No. 5,499,459 to Tomaro seems to relate to a removably placed waterproof bootie but the location of the securing mechanism for removably securing the bootie is located near the top of the shoe.

U.S. Pat. No. 6,618,962 to Covatch seems to relate to a waterproof bootie but the location of the securing mechanism for removably securing the bootie is located near the ankle region of the shoe.

To further enhance comfort, shoes may also utilize pads in select areas of the interior to conform the interior volume of the shoe to the shape of the user's foot.

U.S. Application No. 2001/0007180 to Bordin appears to relate to a foam on the interior of the shoe that conforms to the user's foot. The foam generally encompasses the foot. Although this design may provide enhanced cushioning, the foot may be substantially enclosed and this could cause the foot to perspire, which may lead to discomfort.

U.S. application Ser. No. 5,138,774 to Sarkozi appears to relate to removable pads that may be used to customize fit for a user in select areas of the shoe. The pads may be stacked upon one another in order to reduce interior volume.

U.S. application Ser. No. 4,813,157 to Boisvert, seems to relate to a shoe with releasably connected pad layers for permitting thickness adjustment of various areas of the insole for customizing fit for a user. Similar to Sarkozi, the pads appear to be stacked upon one another in order to reduce interior volume.

Because there are numerous pads that may be stacked upon one another, there may be movement of some of the pads relative to other pads. Also, due to the number of pads, there is increased probability of having one of the pads become dislodged, in which case all pads above the dislodged pad would then become unstable or dislodged.

What is desired, therefore, is a shoe with enhanced comfort and fit. Another desire is a shoe having adjustable support in select areas of the shoe. A further desire is a shoe that has a bootie that is adequately secured within the shoe.

SUMMARY OF THE INVENTION

It is, therefore, an object of the invention to provide a shoe with improved comfort and fit.

Another object is a shoe with better support for the foot where the support may be easily and effectively adjusted by the user.

Another object is a shoe with components securely attached within the shoe.

These and other objects of the invention are achieved by a shoe for providing enhanced comfort and protection to a user's foot having a sole with a top surface, an upper placed above the top surface, an arch made of a single unit of malleable material and attached to the sole and a metatarsal guard made of a single unit of malleable material and placed between the top surface and upper. A bootie having a bottom is removably attached to the top surface by a securing mechanism placed between the top surface and bottom of the bootie. In this fashion, the arch and metatarsal guard conform to a varying size of the foot. It is understood the bootie may be used without the guard or arch, the guard may be used without the bootie or arch, and the arch may be used without the bootie or guard.

In some embodiments, the arch is made of gel or foam. In other embodiments, the metatarsal guard is made of gel or foam.

In further embodiments, the arch is removably attached to the sole. The metatarsal guard is removably attached to an underside of the upper.

In some embodiments, the bootie is made of waterproof and/or insulating material.

In further embodiments, a socklining having a gel layer is placed between the upper and sole for enhancing comfort.

The securing mechanism may be a hook and loop fastener or any other known or novel fastener that permits removably attachment for the guard or arch.

In another aspect of the invention, the shoe uses various combinations of the bootie, arch, and metatarsal guard.

In another aspect of the invention, a method for providing a shoe with enhanced comfort and protection for a user's foot includes the steps of providing a sole with a top surface, placing an upper above the top surface, attaching an arch made of a single unit of malleable material to the sole, and placing a metatarsal guard made of a single unit of malleable material between the top surface and the upper. The method also includes removably attaching a bootie to the top surface by placing a securing mechanism between the top surface and a bottom of the bootie, wherein the arch and the metatarsal guard conform to a varying size of the foot.

In some embodiments, the method further comprises the step of using gel or foam as a material for the arch.

In other embodiments, the method the method further comprises the step of using gel or foam as a material for the metatarsal guard.

In further embodiments, the method includes removably attaching the to the sole. Likewise, the method may include the step of removably attaching the metatarsal guard between the top surface of the sole and the bottom of the bootie.

DETAILED DESCRIPTION

Figure 1:
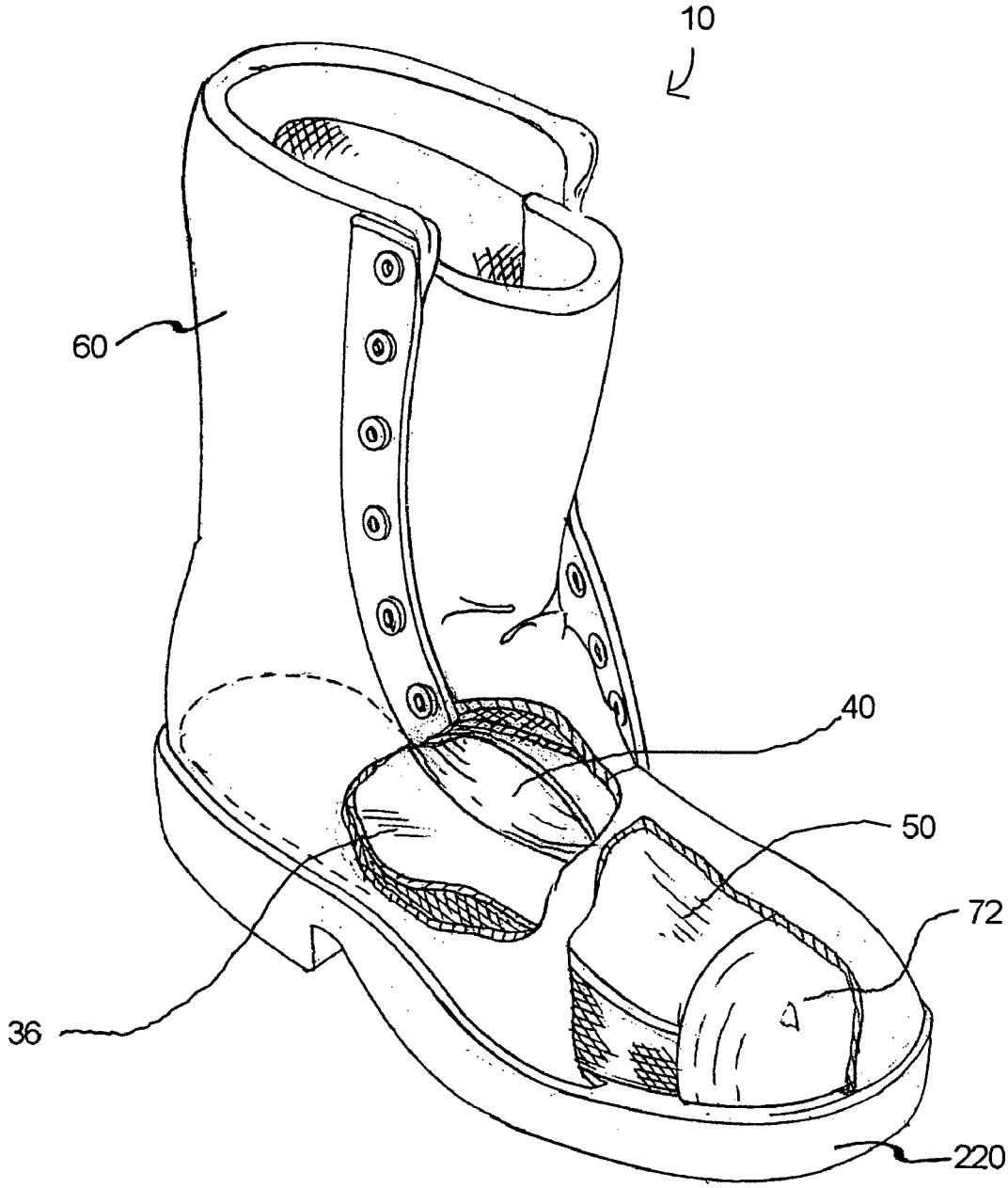
FIG. 1 depicts the shoe in accordance with the invention.
Figure 2:
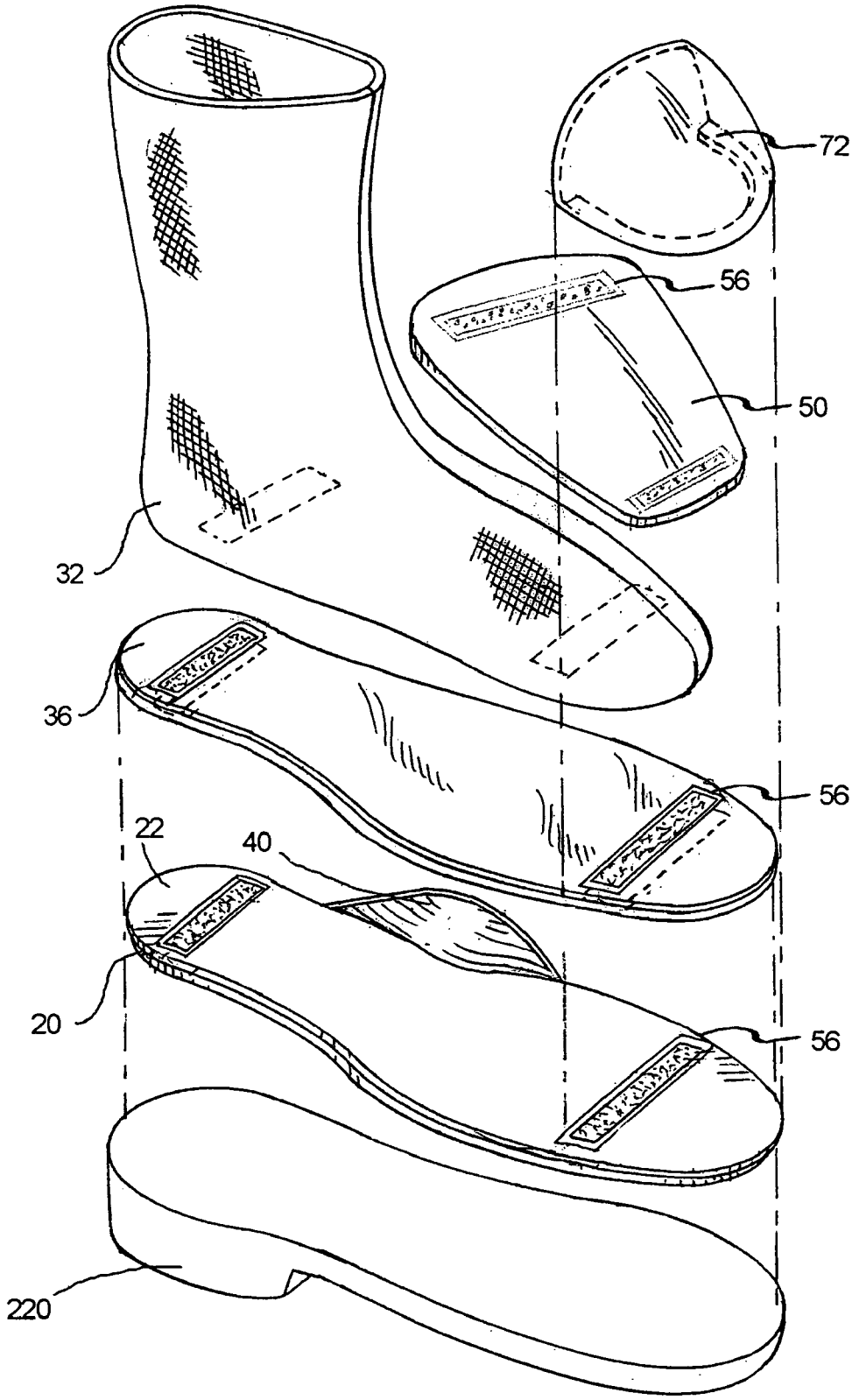
FIG. 2 is exploded view of the shoe shown in FIG. 1.
Figure 3:
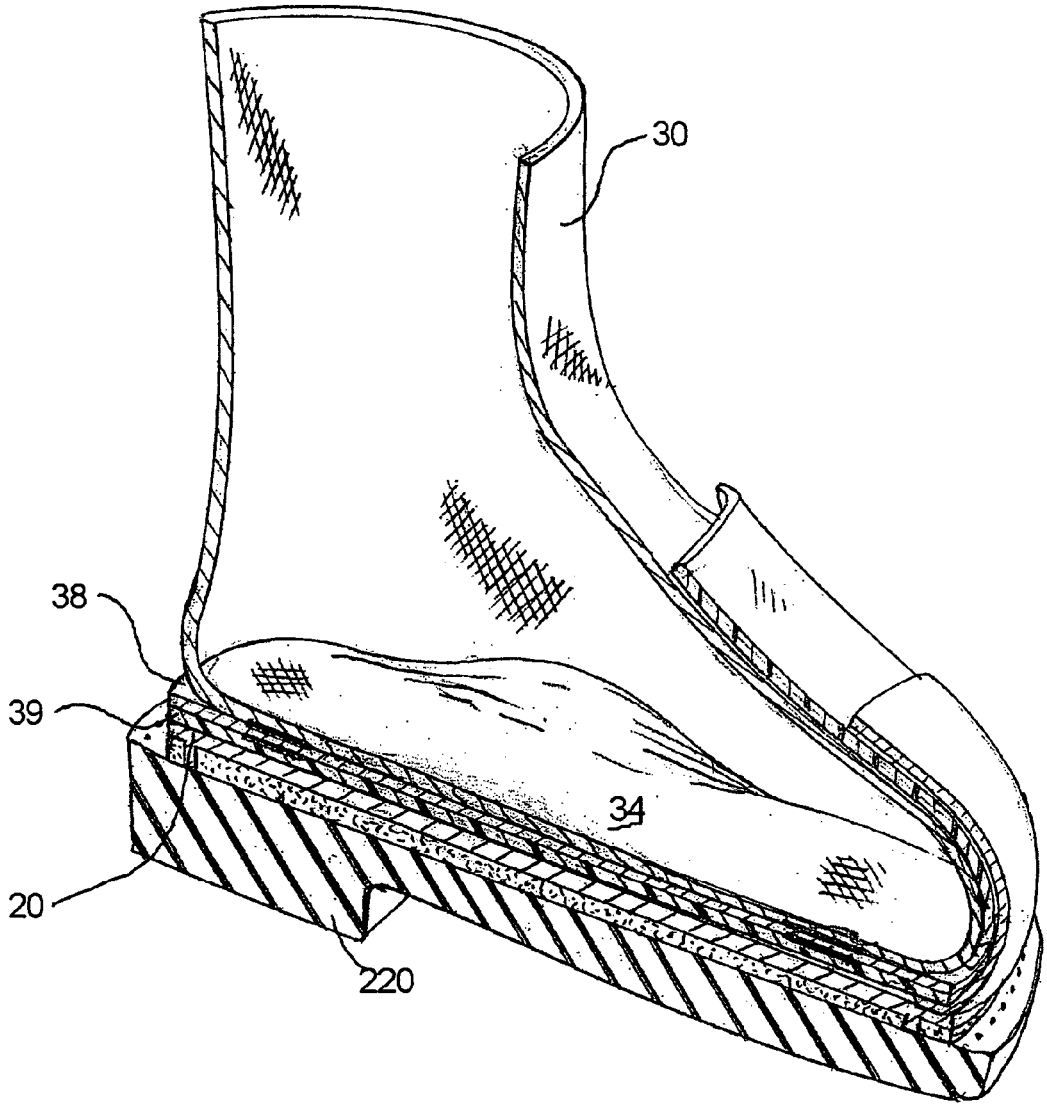
FIG. 3 is cross sectional view of the shoe shown in FIG. 1.

FIGS. 1-3 depict shoe 10 in accordance with the invention. Shoe 10 includes sole 20, upper 60, bootie 30 removably placed within interior 12 of shoe 10, arch 40 attached to sole 20, and metatarsal guard 50 attached to underside 62 of upper 60.

Arch 40 is made of a single unit of gel or visco elastic foam and is removably attached to sole 20. As shown, sole 20 is an insole board placed on top of outsole 220. In other embodiments, sole 20 is a midsole or outsole. The benefit of a gel material is that it conforms to any number of shapes or sizes of the foot. In this manner, arch 40 fits any number of feet and requirements for customizing arch 40 to fit a person's foot is minimized, if not eliminated. Moreover, a gel material expands or contracts automatically and without user intervention as a person's foot expands or contracts, where the foot may change size and shape during the day or as the temperature changes. Foam or visco elastic foam expands or contracts automatically and without user intervention as well and may be used as a material for arch 40.

Because the gel expands or contracts to conform to a user's foot without user intervention, there is no need for arch 40 to be of multiple layers or for layers to be removed since a single unit of gel suffices to expand or contract automatically when a user's foot moves or changes.

Additionally, securing mechanism 56 used to attach arch 40 is any known or novel structure, such as a hook and loop fastener such as Velcro®, adhesive, screws, or other fasteners, that may permit arch 40 to be removably attached to sole 20. In other embodiments, arch is permanently secured by glue, cement, or stitching. In further embodiments, arch 40 is integrally attached to sole 20. In still other embodiments, securing mechanism 56 is a pocket attached to either top surface 22, bottom 32, or both and where arch 40 may be inserted and held in position in either pocket. In yet other embodiments, arch 40 is attached to underside 23 of sole 20.

Bootie 30 is a sock-like insert that is placed within shoe 10. Bootie 30 extends around the foot and up a user's leg, similar to a sock. Bootie 30 may extend to any arbitrary height above the ankle region of the user's leg, depending upon the desired height of shoe 10 or desired height of bootie 30, which may be different than the height of shoe 10.

As shown in FIGS. 2 and 3, bootie 30 includes a securing mechanism 56 placed between bottom 32 of bootie 30 and top surface 22 of sole. The securing mechanism 56 for bootie 30 has the same limitations as the securing mechanism 56 for arch 40 for removably securing bootie 30, and more particularly bottom 32, to sole 20. As shown, the securing mechanism 56 is a hook and loop fastener, such as Velcro® and is also placed on both sides of socklining 36. Socklining 36 may be omitted in which case bootie 30 would be directly on top of sole 20. Although securing mechanism 56 is depicted to be proximate to the toe and heel areas of bottom 32 and sole 20, securing mechanism 56 may be in any location including the entire surface of bottom 32 and bootie 30. Moreover, the shape of securing mechanism 56 may be rounded to conform to the shape of the heel and toes.

It is understood that bootie 30, arch 40, and guard 50 may be used in any combination with shoe 10. In some embodiments, bootie 30 is removably secured to top surface 22 using securing mechanism 56 (as stated above) without arch 40 or guard 50 being used with shoe 10. In other embodiments, arch 40 is employed in shoe 10 but not bootie 30 or guard 50. In further embodiments, both bootie 30 and arch 40 are used in shoe 10 but not guard 50. In yet further embodiments, bootie 30, arch 40, and guard 50 are all used in shoe 10.

Metatarsal guard 50 is a protector for the metatarsal area of the foot and extends from protective toe 72. Guard 50, is attached to underside 62 of upper 60 and extends from protective toe 72, thereby positioning guard 50 on instep portion 102 of underside 62 of upper 60. As shown, guard 50 is removably placed in a select location on underside 62 of upper 60 with a securing mechanism 56 having the same limitations as the securing mechanism 56 for arch 40 or bootie 30. The material for guard 50 includes all of the limitations of the material for arch 40.

Figure 4:
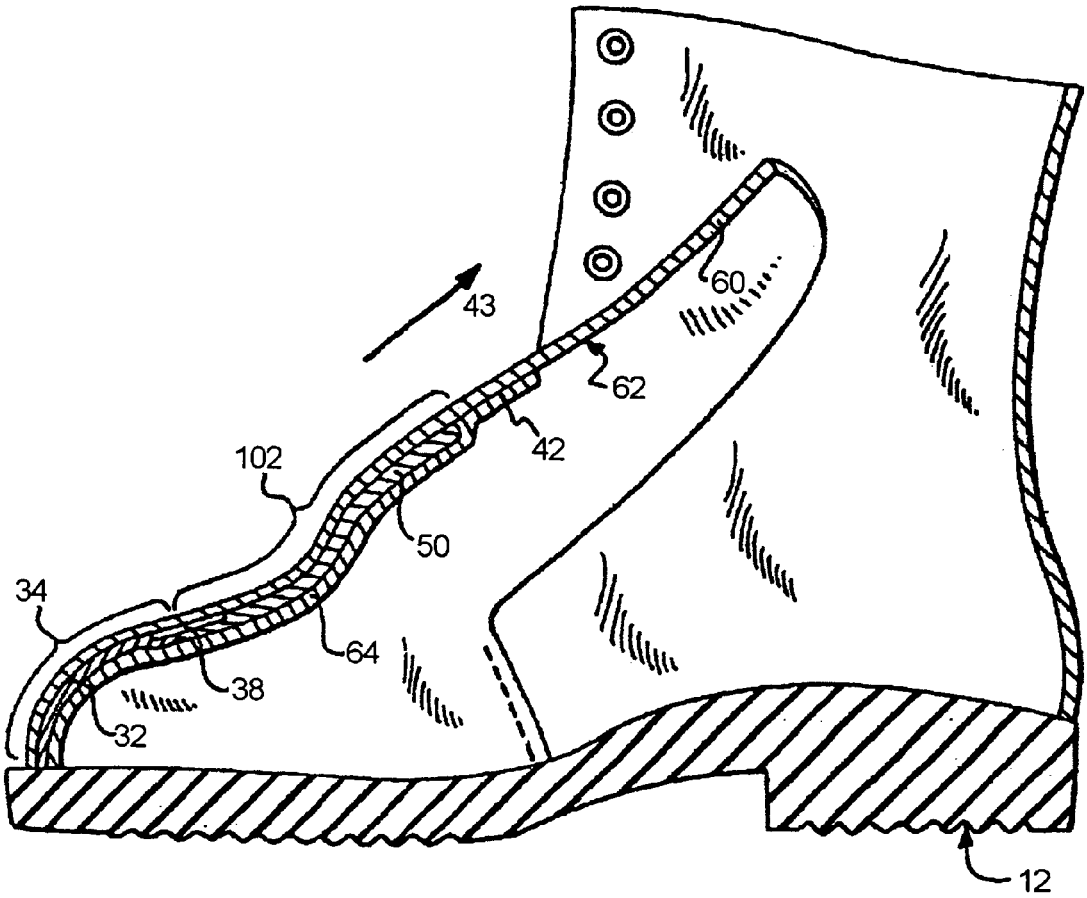
FIG. 4 is another cross sectional view of the shoe shown in FIG. 1.

Optionally, guard 50 is held in place by securing mechanism 56, which is stitching, around perimeter 112 of guard 50 and perimeter 142 of lining 64 to underside 62 of the upper 60. In this manner, guard 50 is sandwiched between lining 64 and upper 60 and maintained in position to protect the metatarsal region of the foot from inadvertent blows of forces. See FIG. 4. Lining 64 provides comfort and may be cloth, cotton, nylon, and the like.

Figure 5:
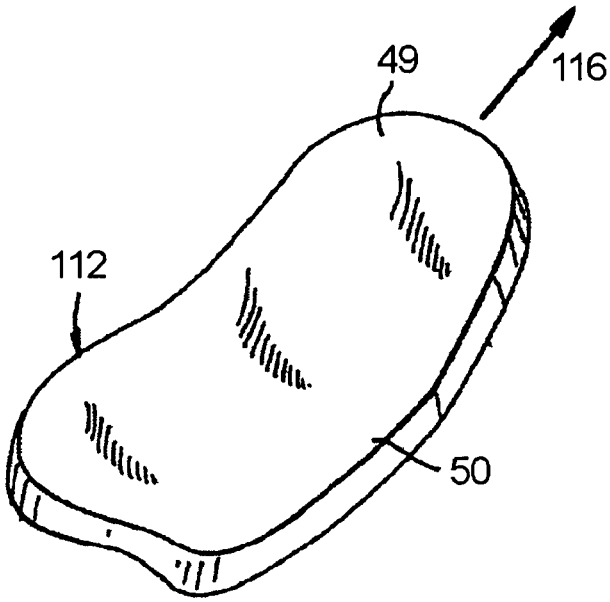
FIG. 5 is a perspective view of the instep guard shown in FIG. 1.

Referring to FIG. 5, guard 50 is a generally planar member that is large enough to cover and protect the metatarsal area of the foot by covering instep portion 102 of shoe 10. Guard 50 is formed from gel, foam, visco elastic, or an elastic material, such as rubber or a suitable synthetic material, which is sufficiently compliant to provide comfort to the foot but is elastic and strong enough to provide protection to the metatarsals of the foot. Similar to the gel or foam material for arch 40, the material for guard 50 permits guard 50 to expand or contract without user intervention to conform to a shape of a user's foot as the foot expands or contracts during use or as the temperature changes. In this fashion, a single unit of gel or foam is sufficient since there is no need for arch 40 to be of multiple layers or for layers to be removed.

In certain instances, guard 50 may be shaped to cover instep portion 102 of the shoe 10, as shown in FIG. 5, to make shoe 10 more comfortable. In these instances, guard 50 may have an ovoid shape and may be elongated along axis 83 to match the shape of instep portion 102 of shoe 10. The thickness of guard 50 is chosen to provide the necessary protection without making the shoe uncomfortable. For example, guard 50 may be a quarter of an inch thick, 4 inches long and 3 inches wide. The elastic material of guard 50 has channels running through it to provide better comfort and protection as described below with references to FIG. 6.

Figure 6:
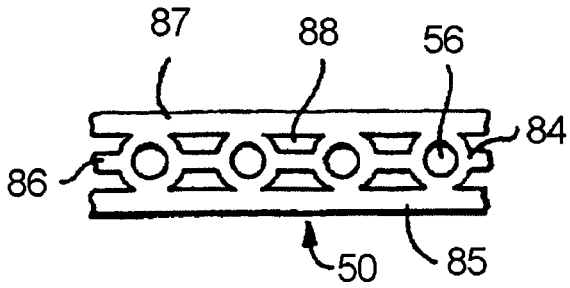
FIG. 6 is a cross sectional view of the instep guard shown in FIG. 5.

Referring to FIG. 6, guard 50 is formed to include hollow channels 86, 88 that absorb shock to the feet without sacrificing comfort. In particular, guard 50 includes a first planar sheet 85 and a second planar sheet 87, with curved support members 84 extending between the planar sheets 85, 87 to define elongated hollow channels 86 with circular cross-sections. The channels extend through guard 50, for example, along axis 116 of the foot. Hollow channels 58 each have a substantially trapezoidal cross-section. Thus, guard 50 defines parallel air-filled channels perpendicular or parallel with axis 116 of the foot to provide protection from inadvertent blows or forces to the metatarsals of the foot without making the shoe uncomfortable.

Figure 7A:
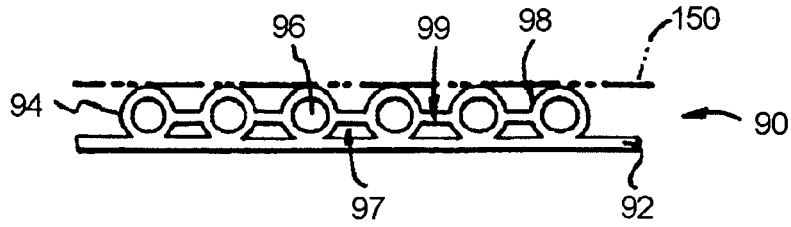
FIGS. 7*a*-7*c* are cross sectional views of alternative embodiments of the instep guard.

Referring to FIG. 7*a*, a first alternative embodiment of the guard 90 has single planar sheet 92 with curved support members 94 extending form planar sheet 92 to define circular air-filled channels 96. Concave surfaces 98 of support members 94 are joined by cross pieces 99 to define air-filled channels 97 with substantially trapezoidal cross-sections.

Figure 7B:
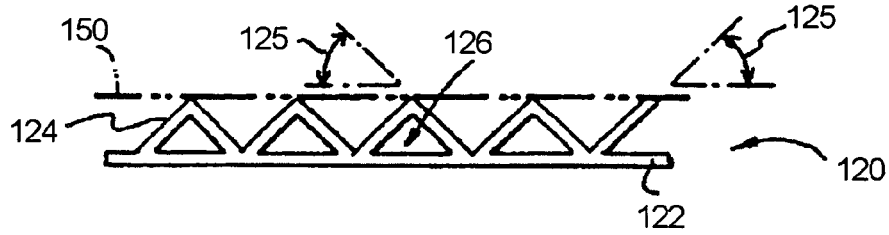

Referring to FIG. 7*b*, a second alternative embodiment of guard 120 that has a single planar sheet 122. Planar support members 124 extend from the planar sheet 122 at angle 125 (such as 60°) to define elongated channels 126 with triangular cross-sections.

Figure 7C:
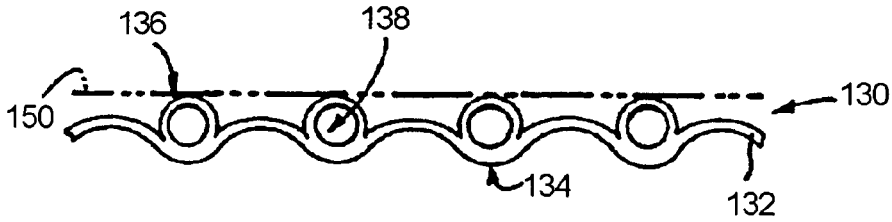

Referring to FIG. 7*c*, a third alternative embodiment of guard 130 includes undulating sheet 132 defining furrows 134. Curved support members 136 extend from furrows 134 to define elongated channels 138, which have ovoid cross-sections. In all three alternate embodiments, it is preferable to have second sheet 150 connected to first sheet 92, 122, 132 by support members 94, 124, 136. However, second sheet 150 may be omitted in certain applications.

Figure 8A:
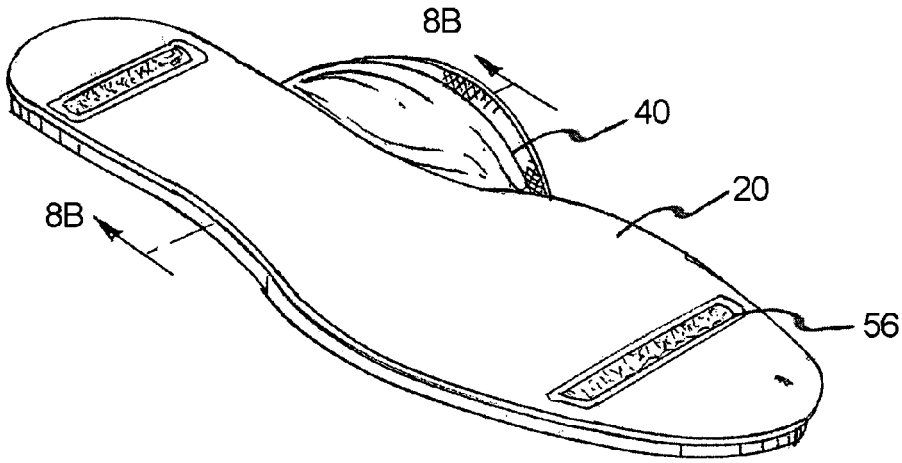
FIGS. 8*a* and 8*b* more particularly depict the sole shown in FIG. 1.
Figure 8B:
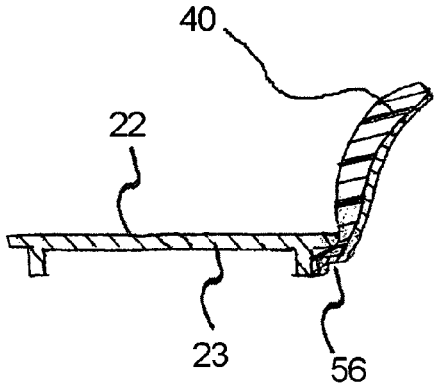

FIGS. 8*a* and 8*b* show the sole 20 having arch 40 attached thereto. Securing mechanisms 56 are also shown. FIG. 8*b* is a cross-sectional view taken from line 8B-8B shown in FIG. 8*a*.

Socklining 36 placed between bottom 32 of bootie 30 and top surface 22 of sole 20. In some embodiments, socklining 36 is secured to top surface 22 and bootie 30 is then secured to fabric layer 38. In further embodiments, socklining 36 is omitted.

As shown, socklining 36 includes gel layer 39 for enhancing softness and fabric layer 38 for receiving a foot, protecting gel layer 39 from wear, and for giving structural integrity to gel layer 39. The absence of fabric layer 38 may lead to a break down of gel layer 39 by bootie 30 or the user's foot.

In other embodiments, socklining 36 is placed within bootie 30, and more particularly on top surface 34 of bootie 30, for enhancing comfort to a user's foot.

Figure 9:
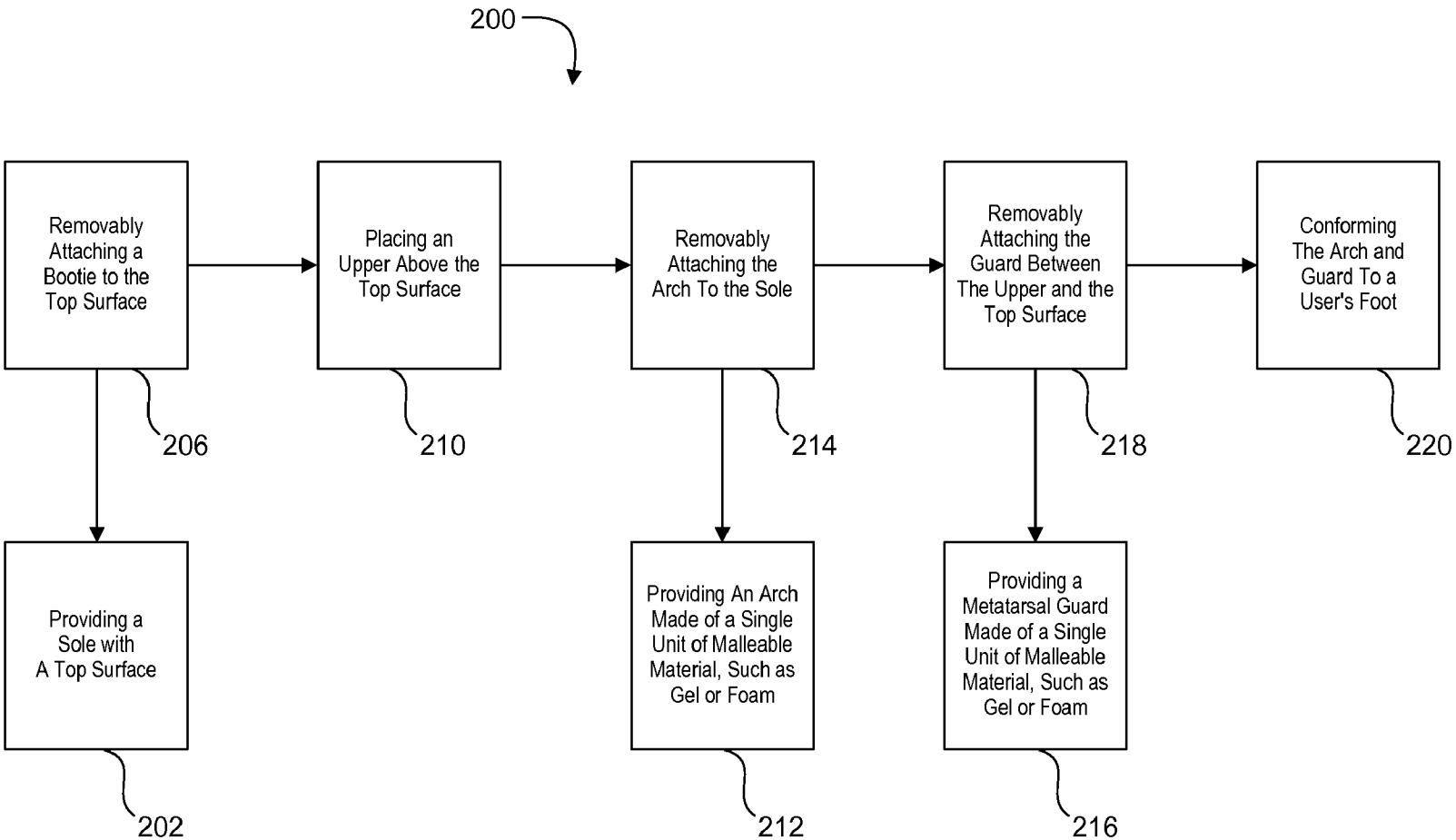
FIG. 9 depicts a method for providing the shoe shown in FIG. 1.

FIG. 9 depicts method 200 for providing a shoe with enhanced comfort and protection for a user's foot, method 200 includes the steps of providing 202 a sole with a top surface and removably attaching 206 a bootie to the top surface by placing a securing mechanism 56 between the top surface and a bottom of the bootie.

Method 200 also includes the steps of placing 210 an upper above the top surface, providing 212 an arch made of a single unit of malleable material, and removably attaching 214 the arch to the sole.

Method 200 further includes providing 216 a metatarsal guard made of a single unit of malleable material and removably attaching 218 the guard between the upper and the top surface.

Finally, method 200 conforms 220 the arch and guard to a user's foot upon the foot being placed within the shoe, regardless of the shape and size of the foot.

In some embodiments, the malleable material for the arch or guard is a gel. In other embodiments, the material is visco elastic foam.

A number of embodiments of the invention have been described. Nevertheless, it will be understood that various modifications may be made without departing from the spirit and scope of the invention. For example, the air-filled channels may have any shape or configuration so long as they provide the necessary protection to metatarsals. For example, they need not be parallel or elongated. Similarly, the instep guard does not require the same shape as the instep portion of the shoe. For example, it could be larger than the instep portion so long as it provides protection to the instep portion. The instep guard may be used with a shoe that does not include a protective toe.

What is claimed is:

1. A shoe providing enhanced comfort and protection for a user's foot, comprising:

a sole having a top surface;

an upper placed above said top surface;

an arch made of a single unit of malleable material and being removably attached to said sole;

a lining secured to an underside of said upper;

a metatarsal guard made of a single unit of malleable material and placed between said lining and said underside of said upper, wherein said lining holds said metatarsal guard in place and provides comfort;

a bootie having a bottom, said bootie is removably attached to said top surface by a securing mechanism placed between said top surface and said bottom of said bootie;

said metatarsal guard is removably attached to said underside of said upper.

2. The shoe according to claim 1, wherein said arch is made of gel.

3. The shoe according to claim 1, wherein said metatarsal guard is made of gel.

4. The shoe according to claim 1, wherein said arch is foam.

5. The shoe according to claim 1, wherein said bootie is made of waterproof material.

6. The shoe according to claim 1, wherein said bootie is made of insulating material.

7. The shoe according to claim 1, wherein said securing mechanism is a hook and loop fastener.

8. The shoe according to claim 1, further comprising a socklining having a gel layer placed between said upper and said bootie.

9. A method for providing a shoe with enhanced comfort and protection for a user's foot, comprising:

providing a sole with a top surface;

placing an upper above the top surface;

removably attaching an arch made of a single unit of malleable material to the sole;

securing a lining to an underside of the upper;

holding a metatarsal guard made of a single unit of malleable material between the lining and the underside of the upper by removably attaching the metatarsal guard to the underside of the upper; and removably attaching a bootie to the top surface by placing a securing mechanism between the top surface and a bottom of the bootie.

10. The method according to claim 9, further comprising the step of using gel as a material for the arch.

11. The method according to claim 9, further comprising the step of using foam as a material for the arch.

12. The method according to claim 9, further comprising the step of using foam as a material for the metatarsal guard.

13. The method according to claim 9, further comprising the step of removably attaching the bootie, arch, and guard with a securing mechanism selected from the group consisting of a hook and loop fastener, adhesive, and combinations thereof.

14. The shoe according to claim 1, wherein said bootie, arch, and guard are removably attached using a securing mechanism selected from the group consisting of a hook and loop fastener, adhesive, and combinations thereof.

* * * * *